United States Patent [19]

Tomita et al.

[11] Patent Number: 4,855,200

[45] **Date of Patent: * Aug. 8, 1989**

[54] FLUORESCENT SCREENS OF COLOR PICTURE TUBES AND MANUFACTURING METHOD THEREFOR

[75] Inventors: Yoshifumi Tomita; Masahiro Nishizawa, both of Mobara; Saburo Nonogaki, Meguro, all of Japan

[73] Assignee: Hitachi, Ltd., Tokyo, Japan

[ * ] Notice: The portion of the term of this patent subsequent to Jul. 5, 2000 has been disclaimed.

[21] Appl. No.: 142,360

[22] Filed: Dec. 28, 1987

Related U.S. Application Data

[63] Continuation of Ser. No. 831,119, Feb. 20, 1986, abandoned, which is a continuation of Ser. No. 361,268, Mar. 24, 1982, abandoned.

[30] Foreign Application Priority Data

Mar. 27, 1981 [JP] Japan ..... 56-43918

[51] Int. Cl.[4] ..... G03C 5/00; H01J 9/227

[52] U.S. Cl. ..... 430/25; 430/23; 430/24; 430/28; 430/144

[58] Field of Search ..... 430/24, 25, 28, 23, 430/144

[56] References Cited

U.S. PATENT DOCUMENTS

| | | | |
|---|---|---|---|
| 3,146,368 | 8/1964 | Fiore et al. | 430/25 |
| 3,738,233 | 6/1973 | Schwartz | 430/24 |
| 3,879,632 | 4/1975 | Dietch | 427/68 |
| 4,100,321 | 7/1978 | Schlesinger et al. | 430/144 |
| 4,205,255 | 5/1980 | Tomita et al. | 313/470 |
| 4,223,083 | 9/1980 | Engstrom | 430/24 |
| 4,234,669 | 11/1980 | Pearlman | 430/25 |
| 4,273,842 | 6/1981 | Nonogaki et al. | 430/25 |
| 4,331,752 | 5/1982 | Yokomizo et al. | 430/25 |
| 4,391,885 | 7/1983 | Tomita et al. | 430/28 |

*Primary Examiner*—Charles L. Bowers, Jr.
*Attorney, Agent, or Firm*—Charles E. Pfund

[57] ABSTRACT

A high contrast and brightness fluorescent screen of a color picture has a light absorbing layer in the form of fine dots or stripes provided for the inner surface of a panel of the tube on which the phosphor layer is formed, and a light reflection layer provided at an interface between the light absorbing layer and the phosphor layer. To manufacture the fluorescent screen, a phtosensitive resin layer coated on an inner surface of the panel is exposed to light through a photomask mounted on outside of the panel to form a pattern. Nonluminous light absorbing substance is applied on the pattern to form the light absorbing layers.

6 Claims, 1 Drawing Sheet

FLUORESCENT SCREENS OF COLOR PICTURE TUBES AND MANUFACTURING METHOD THEREFOR

This is a file wrapper of co-pending application Ser. No. 06/831,119 filed on Feb. 20, 1986, abandoned, which was a continuation of Ser. No. 361,268 filed on Mar. 24, 1982, abandoned.

BACKGROUND OF THE INVENTION

This invention relates to a fluorescent screen of a color picture tube and a manufacturing method therefor.

As a high contrast fluorescent screen there is known a so-called black matrix type fluorescent screen in which the spaces between phosphor layers are covered by a black matrix layer made of such nonluminous and light absorptive substance as graphite.

In the field of the color picture tube using the black matrix type fluorescent screen, it has long been desired to further improve contrast without degrading contrast. To this end, highly effective absorption of external light and highly effective reflection of light emitted by phosphors are necessary in the fluorescent screen. However, existing color picture tube fluorescent screens never fulfill the above requirements. Therefore, advent of a novel black matrix type fluorescent screen which is highly improved in contrast has been desired.

SUMMARY OF THE INVENTION

Accordingly an object of this invention is to provide a novel fluorescent screen of a color picture tube which can be highly improved in contrast.

Another object of this invention is to provide a method for manufacture of the high contrast fluorescent screen which can eliminate misalignment of component elements, spoiling of a photosensitive resin layer, etc.

According to one aspect of this invention, there is provided a fluorescent screen of a color picture tube comprising a light absorption layer of non-luminous light absorptive substance patterned on the inner surface of a panel of the tube, a light reflection layer patterned on the light absorption layer, a phosphor layer formed on the inner surface of the panel to cover the light absorption layer pattern and the light reflection layer pattern, and a reflective film formed on the phosphor layer.

According to another aspect of this invention, there is provided a method of manufacturing a fluorescent screen of a color picture tube of the type wherein fine light absorption layers of non-luminous light absorbing substance are coated on an inner surface of a panel of the color picture tube and then phosphor layers are formed on the light absorption layers, characterized by the steps of forming a photosensitive resin layer on the inner surface of the panel, mounting a photomask on the outside of the panel, exposing the photosensitive resin layer through the photomask to form a pattern of the light absorption layers, and applying the nonluminous substance or a substance convertible thereto according to the pattern thereby forming the light absorbing layers.

DESCRIPTION OF THE PREFERRED EMBODIMENTS

Figure 1A:
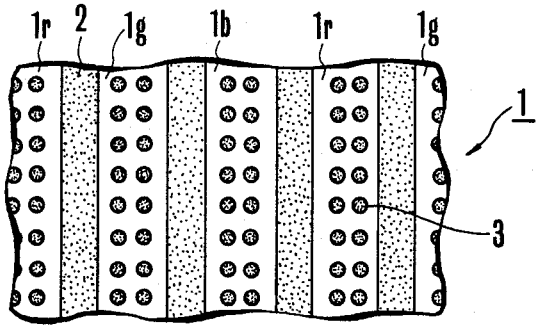
FIG. 1*a* is a plan view showing a fluorescent screen of a color picture tube according to the invention in which fine light absorption layers and a black matrix layer are formed on the inner surface of a panel.
Figure 1B:
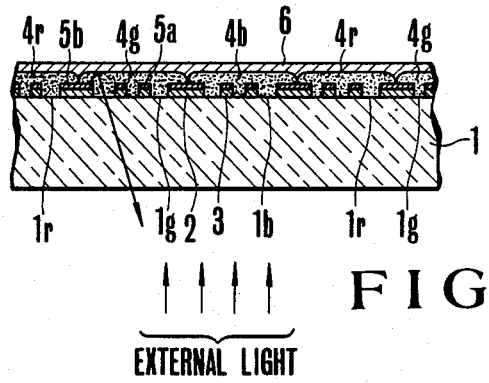
FIG. 1*b* is a sectional view of the fluorescent screen shown in FIG. 1*a* with phosphor layers and a reflection layer formed on the light absorption layers and black matrix layer.

According to the present invention, as shown in FIGS. 1*a* and 1*b*, a light absorption layer in the form of fine dots or stripes is provided for the inner surface of a panel on which the phosphor layer is formed and a light reflection layer is provided at an interface between the light absorption layer and the phosphor layer for the purpose of realizing a high contrast by decreasing reflection of external light by the phosphor layer.

Taking a black matrix type fluorescent screen, for example, a stripe shaped black matrix layer 2 is patterned on the inner surface of the panel 1 of a color picture tube. In addition, fine dot shaped light absorption layers 3 are patterned on portions of the inner surface of the panel where the black matrix layer is not formed, that is, in black matrix windows 1*g*, 1*b* and 1*r*, and, phosphor layers 4*g*, 4*b* and 4*r* for three colors are formed thereon. The layer patterns 2 and 3 are made of non-luminous light absorptive substance such as graphite. On the surfaces of the light absorption layers 3 and the black matrix layer 2 on the side facing an electron gun structure, not shown, there are provided reflective layers 5*a* and 5*b*, and the surfaces of the phosphor layers 4*g*, 4*b* and 4*r* facing the electron gun structure are covered by an aluminum reflection film 6.

Since external light is efficiently absorbed not only by the black matrix layer 2 but also by the light absorption layer pattern 3, the percentage of reflection of the external light over the entire surface of the fluorescent screen decreases greatly. Moreover, light emitted by the phosphor layers due to electron beam bombardment is reflected to the outside by the reflection films 5*a* and 5*b* and the aluminum layer 6. Since the reflection films 5*a* are in the form of fine dots, there is no appreciable decrease in the brightness. Consequently, it is possible to greatly improve the contrast.

In the manufacture of this type of fluorescent screen of a color picture tube, a shadow mask is generally used as a photomask at the time of exposure for forming the black matrix layer 2 as well as the phosphor layers 4*g*, 4*b* and 4*r*. As a method of forming small dot shaped light absorption layers 3, a method using a photomask brought into intimate contact with the inner surface of the panel coated with a photosensitive resin is most desirable from the standpoint of the accuracy. However, it is not easy to accurately position the photomask throughout the entire inner surface of a curved panel. Thus, there are such fears as misalignment, contamination and damage of the photosensitive resin layer. Even in a case of close exposure in which the photomask is not brought into intimate contact with the inner surface of the panel, it is necessary to carry out a difficult working for inserting the photomask between the inner surface of the panel formed with the photosensitive resin layer and the shadow mask.

Figure 2:
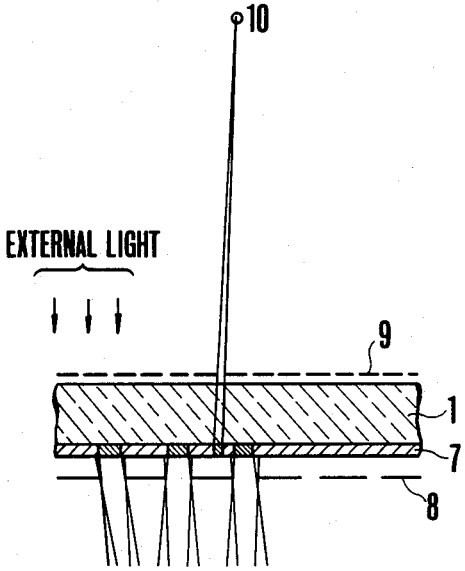
FIG. 2 is a sectional view showing a portion of the panel during an exposure step.

FIG. 2 is a sectional view of a portion of a panel during the exposure step of a method of forming the fluorescent screen of a color picture tube according to this invention which can eliminate the above inconveniences. As shown, a photosensitive sticky layer 7 is formed on the inner surface of a panel 1, that is, on the surface facing an electron gun structure not shown. For the photosensitive sticky layer 7 that manifests stickiness when irradiated with light, a mixture of a diazonium salt and an aqueous solution of a high molecular substance, for example, is used. The solution is uniformly coated on the inner surface of the panel 1 by a conventional spin coating method to form the photosensitive sticky layer 7. A shadow mask 8 having slot shaped apertures is mounted adjacent to the inner surface of the panel. The shadow mask is mounted at the same position as that when the color picture tube is used. On the other hand, a photomask 9 having minute circular apertures is mounted on the outer surface of the panel 1 and a point light source 10 is disposed exteriorly of the photomask 9.

To form a black matrix layer 2 by using a conventional light exposure device, the photosensitive sticky layer 7 formed on the inner surface of the panel 1 is exposed to light from inside of the panel. In this case, the light source is positioned at a position displaced from a position of the light source for exposing respective black matrix windows 1*g*, 1*b* and 1*r* in a perpendicular direction with respect to the longitudinal direction of the slots of the shadow mask 8. The amount of displacement can be given by, $$\tfrac{1}{2}\cdot S = 1/6\cdot H_p\cdot(1+p/q)$$

where S represents a spacing between light sources when independently exposing respective black matrix windows 1*g*, 1*b* and 1*r*, p the distance between the light source and the shadow mask 8, q the distance between the shadow mask 8 and the photosensitive sticky layer 7, and $H_p$ the horizontal pitch of the slots of the shadow mask 8. In this manner, the light sources for exposing black matrix windows 1*g*, 1*b* and 1*r* are displaced in the same direction by S/2 for exposing the portions of the black matrix layer respectively between the black matrix windows 1*g* and 1*b* between 1*b* and 1*r* and between 1*r* and 1*g*. At the same time, by the point source 10 the photosensitive sticky layer 7 is irradiated through the photomask 9 and the panel 1, thus exposing portions which form the light absorption layers 3. In this case, the dimension of the apertures of the photomask 9, the size of the point source 10, and the distance between the photomask 9 and the point source 10 are selected in accordance with the dimension of the dot shaped light absorption layers 3. After the light exposure of the photosensitive sticky layer 7, a fine powder of graphite is sprayed with a spray gun and developed by air to form a black matrix surface including the black matrix layer 2 and the light absorption layers 3. Then, the panel 1 under this state is left standing for a while to cause the photosensitive sticky layer which has been rendered sticky by the light exposure to ooze to the outside through a layer of the fine graphite. Thereafter, a fine white powder of titanium oxide, alumina or magnesia, for example, is sprayed followed by air development to form reflective films 5*a* and 5*b* on the surfaces of the light absorption layers 3 and the black matrix layer 2 facing the electon gun structure. If the layer of the fine graphite is too thick, the sticky liquid can not ooze out sufficiently so that it becomes impossible to coat thereon the fine white powder. For example, when the photosensitive sticky layer is formed to a thickness of 0.5 microns, 2 to 3 mg/cm$^2$ of the quantity of the applied fine powder is sufficient when two layers of the graphite and the fine white powder are considered. Then by using a conventional light exposure device, the position of green, a first color, is exposed to light from the side of the electron gun structure followed by application of a powder of green phosphor and air development to form the phosphor layer 4*g*. Then, similar steps are repeated for the second color blue and the third color red. Thereafter an aluminum reflective film 6 is formed by an ordinary filming step and aluminum vapor deposition.

As described above, the structure of the fluorescent screen of this invention can improve contrast without degrading brightness. When forming dot shaped light absorption layers 3 in the black matrix windows 1*g*, 1*b* and 1*r*, the photosensitive sticky layer 7 coated on the inner surface of the panel 1 is exposed to light from the outside of the panel so that it is possible to mount the photomask on the outside of the panel. Accordingly, it is possible to eliminate such problems as misalignment of mounting, spoiling the photosensitive film, etc., which occur when the exposure is made with the photomask in close contact with the inner surface of the panel as in the prior art method. Moreover, it becomes possible to eliminate the difficult work of inserting a photomask between the inner surface of the panel and the shadow mask. Further, as a photosensitive agent which becomes sticky when exposed to light is used, it is possible to extremely readily form double layers of the light absorption layers 3 and the reflective layers 5*a* by utilizing the oozing of the sticky liquid.

One example of this invention will now be described.

Firstly, an aqueous solution of a photosensitive sticky agent having the following composition is prepared.

| | |
|---|---|
| arginic acid-polypropylene glycol ester | 0.2 wt. % |
| polyvinyl alcohol | 0.06 wt. % |
| P—dimethyl aminobenzene diazonium chloride, zinc chloride | 3.3 wt. % |
| water | balance |

Then, the aqueous solution is coated by rotating means onto the inner surface of the panel glass of a 20 inch color picture tube and dried. Then, by using an exposure device in which the position of the light source has been set such that the light will impinge upon a position of the photosensitive film or the inner surface of the panel glass at which a first black stripe is to be formed, a first time light exposure is executed through the shadow mask. Then, the position of the light source is moved to expose the portions at which the second and third black matrix stripes are to be formed. Each exposure time is about 60 seconds. At the time of the exposure, a photomask in which apertures having a diameter of 20 microns are arranged to form regular triangles with a pitch of 40 microns is mounted on the outer surface of the panel, and light is projected for about 5 minutes from a point light source having a diameter of 1 mm and vertically spaced by 1 m from the center of the outer surface of the panel. After completing the exposure from inside and outside of the panel, the shadow mask is removed from the panel. Then, a powder of graphite having a diameter of from about 0.5 to 1 micron is dry sprayed onto the inner surface of the panel. Then, air is blasted for about one minute to perform developing. After the panel is left standing for about 3 minutes a fine powder of $TiO_2$ having a diameter of from about 1 to 1.5 microns is sprayed and developed with air. Then the shadow mask is mounted again, and the photosensitive film is exposed to light through the shadow mask by using a exposure device with the light source set at a position for exposing the position of the first matrix window. Then a powder of a phosphor of a first color is sprayed to the exposed position followed by air development to form phosphor stripes of the first color. At this time, since the nearby photosensitive sticky agent diffuses onto the two layers of the dot shaped graphite and $TiO_2$, the powder of the phosphor is applied on the sticky agent. Then, similar steps are repeated for the second and third black matrix windows to form phosphor stripes of the second and third colors. After wetting the inner surface of the panel with water, a toluene solution of an acrylic polymer is sprayed to form a film thereof and aluminum is vapor deposited thereon to complete a fluorescent screen.

Figure 3:
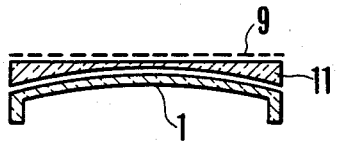
FIG. 3 is a sectional view showing a portion of a modified panel during an exposure step.

In the foregoing embodiment, the panel 1 is spherical, while the photomask 9 is flat, so that as shown in FIG. 3, a flat-concave lens shaped transparent substrate 11 may be interposed between the panel and the photomask to align them.

Although in the foregoing embodiment graphite was used as a nonluminous light absorbing substance that constitutes light absorption layers and a black matrix layer beneath the phosphor layer, the invention is not limited to the use of an inherently black material. For example, any material such as $MnCO_3$ which can be converted into a nonluminous and light absorbing substance after it is coated on the panel and then heated can also be used.

Further, although in the foregoing embodiment dot shaped light absorption layers were used, the layers may take the form of stripes.

Further, in the above-described embodiment a so-called black matrix type fluorescent screen was described in which the spaces between phosphor layers of respective colors were filled pattern-wise with nonluminous light absorptive substance, the invention is not limited thereto. For example, the invention is also applicable to a fluorescent screen not using any black matrix layer.

Instead of using a photosensitive sticky agent and a powder of nonluminous light absorbing substance for forming the light absorption layers, a slurry method or another method utilizing photosensitive agent can also be used.

As described above according to the manufacturing method of this invention, a photosensitive resin layer coated on the inner surface of a panel is exposed to light projected from the outside of the panel so that a photomask can be mounted on the outside of the panel whereby it is possible to eliminate various defects described above caused by mounting the photomask on the inner side of the panel. Moreover, it is not necessary to perform troublesome working of inserting the photomask between the inner surface of the panel and the shadow mask. As a consequence, it is possible to obtain a color picture tube having a high contrast at a low cost.

What is claimed is:

1. In a method of manufacturing color picture tubes which tubes include a panel the inner surface of which is coated with a pattern of a black matrix layer and a pattern of a fine dot light absorptive layer of a non-luminous light absorption substance, and a reflective layer on said fine dot light absorptive layer, said black matrix layer, said light absorptive layer, and said reflective layer being overlaid with fluorescent material to form a fluorescent screen for said color tube, which method comprises the steps of:

forming on the inner surface of said panel a photosensitive resin layer which becomes sticky upon exposure to light;

mounting a photomask on the outside of said panel;

exposing to light said photosensitive resin layer through at least the photomask to form a pattern of sticky portions of said resin layer at which a fine dot pattern of said light absorption layer is to be formed, and whereby the portion of the resin layer not being exposed to light will not be made sticky;

applying said non-luminous light absorbing substance or a substance convertible thereto on said photosensitive resin layer and developing with air to form a pattern of said light absorbing layer corresponding to the pattern of said sticky portions of said resin layer;

delaying performance of the next step long enough for some of said sticky substance to ooze through the pattern of said light absorbing layer to the surface of said light absorbing substance;

spraying a fine powder of white material on the surfaces of the pattern of said light absorbing layer where said sticky substance has oozed through and developing said surfaces with air to form a fine dot pattern of said light absorbing layer on the surface of which a light reflection layer is deposited.

2. A method according to claim 1 wherein said exposing is effected through said photomask and a flat-concave lens shaped transparent substrate disposed between the photomask and the panel.

3. A method of manufacturing a fluorescent screen for a black matrix type color picture tube wherein said tube includes a panel, a pattern of a black matrix layer formed on the inner surface of said panel, the pattern of said black matrix layer having windows where a layer of phosphor powder of respective kinds of color is to be formed, a pattern of an additional light absorbing layer being formed within said windows, and a light reflecting layer being formed on both the pattern of said black matrix layer and the pattern of said additional light absorbing layer, said method comprising the steps of:

(A) forming a photosensitive resin layer which becomes sticky upon exposure to light on the inner surface of said panel;

(B) mounting a shadow mask on the inside of said panel;

(C) exposing said photosensitive resin to light from an internal light source through the shadow mask to form a pattern of sticky portions of said resin layer at which said black matrix pattern layer will be formed and leaving windows in said black matrix pattern layer where said resin is not exposed to light;

(D) exposing to light, from an external light source, portions of said windows left in said sticky portions, said exposure being through a photomask mounted on the outside of said panel to form a further pattern of sticky portions of said resin layer in said windows at which said additional light absorbing pattern layer is to be formed within the respective windows in the black matrix pattern;

(E) removing the internal shadow mask;

(F) applying a non-luminous absorbing substance or a substance convertible thereto on said pattern of sticky portions and said further pattern of sticky portions to form said pattern of said black matrix layer and a pattern of said additional light absorbing layer, respectively;

(G) delaying performance of the next step long enough for some of the sticky photosensitive resin to ooze through said light-absorbing substance to the surface thereof;

(H) applying a fine powder of white material on the surfaces of said black matrix and additional light-absorbing pattern layers where said sticky photosensitive resin has oozed through and developing said layers by air to form the light reflection layers;

(I) mounting again the shadow mask;

(J) exposing to light from the internal light source said photosensitive resin layer through said shadow mask to form a pattern of sticky portions of said resin layer at which a phosphor powder layer is to be deposited within the respective windows in the black matrix pattern;

(K) removing again said shadow mask;

(L) applying a phosphor powder over the photosensitive resin layer to form the phosphor powder layer within the respective windows.

4. A manufacture method according to claim 3 wherein said steps (C) and (D) are carried out simultaneously.

5. A manufacture method according to claim 3 wherein said additional light absorbing pattern layer is of a fine dot pattern.

6. A manufacture method according to claim 3 further comprising, after said step (L), a step of depositing an aluminum film on said phosphor powder layer.

* * * * *